US008603306B2

(12) United States Patent
Hwang

(10) Patent No.: US 8,603,306 B2
(45) Date of Patent: Dec. 10, 2013

(54) CLEANING DEVICE

(75) Inventor: In-Seok Hwang, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 270 days.

(21) Appl. No.: 13/087,124

(22) Filed: Apr. 14, 2011

(65) Prior Publication Data

US 2012/0006677 A1 Jan. 12, 2012

(30) Foreign Application Priority Data

Jul. 12, 2010 (KR) ..... 10-2010-0067090

(51) Int. Cl.
*C25F 1/00* (2006.01)
*C25F 7/00* (2006.01)

(52) U.S. Cl.
USPC ..... 204/275.1; 204/297.1; 205/705

(58) Field of Classification Search
USPC ..... 204/297.12, 297.14, 297.1
See application file for complete search history.

(56) References Cited

U.S. PATENT DOCUMENTS

| | | | | | |
|---|---|---|---|---|---|
| 258,214 | A * | 5/1882 | Brinckmann | 204/297.12 |
| 625,489 | A * | 5/1899 | Buck | 204/297.12 |
| 768,818 | A * | 8/1904 | Nelson | 205/705 |
| 2,760,923 | A * | 8/1956 | Boguski | 205/217 |
| 3,394,819 | A * | 7/1968 | Saville | 211/41.1 |
| 3,457,151 | A * | 7/1969 | Kortejarvi | 205/722 |
| 4,879,007 | A * | 11/1989 | Wong | 205/137 |
| 5,104,501 | A * | 4/1992 | Okabayashi | 205/722 |
| 5,344,540 | A * | 9/1994 | Heinke et al. | 204/232 |
| 5,478,450 | A * | 12/1995 | Buck | 205/705 |
| 6,203,691 | B1 * | 3/2001 | Hoffman et al. | 205/705 |
| 6,264,823 | B1 * | 7/2001 | Hoffman et al. | 205/687 |
| 6,818,104 | B2 | 11/2004 | Iwasaki et al. | |
| 6,960,282 | B2 * | 11/2005 | Bezama et al. | 204/224 R |
| 7,040,741 | B2 | 5/2006 | Nakamura et al. | |
| 7,116,348 | B2 | 10/2006 | Nakamura et al. | |
| 7,312,154 | B2 | 12/2007 | Cites et al. | |
| 7,510,272 | B2 | 3/2009 | Nakamura et al. | |
| 2002/0157964 | A1 * | 10/2002 | Hoffman et al. | 205/670 |
| 2005/0167284 | A1 * | 8/2005 | Giri et al. | 205/703 |
| 2005/0248715 | A1 | 11/2005 | Byun et al. | |
| 2006/0086622 | A1 * | 4/2006 | Prior | 205/641 |

FOREIGN PATENT DOCUMENTS

| | | |
|---|---|---|
| JP | 2002086691 | 3/2002 |
| KR | 1985-0001799 | 12/1985 |
| KR | 100124479 B | 9/1997 |
| KR | 100241154 B | 2/2000 |
| KR | 1020010007269 A | 1/2001 |
| KR | 1020020027072 A | 4/2002 |
| KR | 100948395 B | 3/2010 |

* cited by examiner

*Primary Examiner* — Harry D Wilkins, III
(74) *Attorney, Agent, or Firm* — Robert E. Bushnell, Esq.

(57) ABSTRACT

A cleaning device includes a cleaning solution tank filled to a predetermined height with an electrolyte solution, a negative electrode provided inside the cleaning solution tank, a metal jig mounted with a metal mask used to manufacture an organic light emitting diode (OLED) display to one side for guiding the metal mask to be connected to the negative electrode, positive electrodes installed at predetermined intervals inside the cleaning solution tank with along with a metal mask, and a rectifying device electrically connected to the negative electrode and the positive electrodes.

7 Claims, 5 Drawing Sheets

CLEANING DEVICE

CLAIM OF PRIORITY

This application makes reference to, incorporates the same herein, and claims all benefits accruing under 35 U.S.C. §119 from an application earlier filed in the Korean Intellectual Property Office on Jul. 12, 2010 and there duly assigned Serial No. 10-2010-0067090.

BACKGROUND OF THE INVENTION

1. Field of the Invention

The described technology relates generally to a cleaning device. More particularly, the described technology relates to a cleaning device for removing foreign particles attached to a cleaning target object.

2. Description of the Related Art

In general, a deposition process using a metal mask is applied when forming an organic material layer for an organic light emitting element in an organic light emitting diode (OLED) display.

To manufacture an organic light emitting diode (OLED) display of high quality, it is important to clean the metal mask. The reason for this is that, if contamination particles from the surrounding environment or the organic material coated in the deposition process are not completely eliminated and remain on the surface of the metal mask surface, the desired deposition process of the organic material is not normally executed such that the production yield may be affected.

The above information disclosed in this Background section is only for enhancement of an understanding of the background of the described technology, and therefore it may contain information that does not form the prior art which is already known in this country to a person of ordinary skill in the art.

SUMMARY OF THE INVENTION

The present invention comprises a cleaning device capable of efficiently cleaning a cleaning target object.

A cleaning device according to an exemplary embodiment of the invention includes: an electrolyte cleaning solution tank filled to a predetermined height with an electrolyte solution; a negative electrode provided inside the electrolyte solution tank; a metal jig mounted with a metal mask used to manufacture an organic light emitting diode (OLED) display to one side, and guiding the metal mask so as to be connected to the negative electrode; positive electrodes installed at predetermined intervals inside the electrolyte cleaning solution tank along with the metal mask; and a rectifying device electrically connected to the negative electrode and the positive electrodes.

The cleaning device may further include: a negative bus bar installed at a lower portion of the electrolyte solution tank for transmitting a negative voltage supplied by the rectifying device to the negative electrode; and an elastic member installed on the negative bus bar and contacting the negative electrode.

The upper portion of the metal jig may be connected to a catching bar which is slung over one side of the electrolyte cleaning solution tank.

The cleaning device may further include: a robot for horizontally and vertically moving the metal jig into a predetermined position to load and unload the metal jig inside the cleaning solution tank through an inlet formed in the upper portion of the cleaning solution tank; a remote control device for remotely controlling the rectifying device and the robot by means of a predetermined program; and a display device for displaying the state of the rectifying device and the remote control device.

The plurality of the positive electrodes may be installed on the inner surface of the cleaning solution tank at an interval from the metal jig, and may be disposed in correspondence to the metal mask.

The cleaning device may further include a cover for covering the upper inlet of the cleaning solution tank, the cover may be connected to an exhaust line for exhausting a gas generated in the cleaning solution tank, and the exhaust line may be installed with a gas densitometer for detecting the concentration of the gas passing through the exhaust line.

The gas densitometer may be a hydrogen densitometer for detecting the concentration of hydrogen.

The cleaning device may further include an insulating member interposed between the metal mask and the metal jig.

As described above, according to the present invention, the metal mask may be easily cleaned in a state in which the negative electrode contacts the cleaning target object.

In addition, by using the robot, the metal mask may be easily loaded at a predetermined position of the cleaning solution tank, that is, at the negative bus bar installed at the lower portion of the cleaning solution tank.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
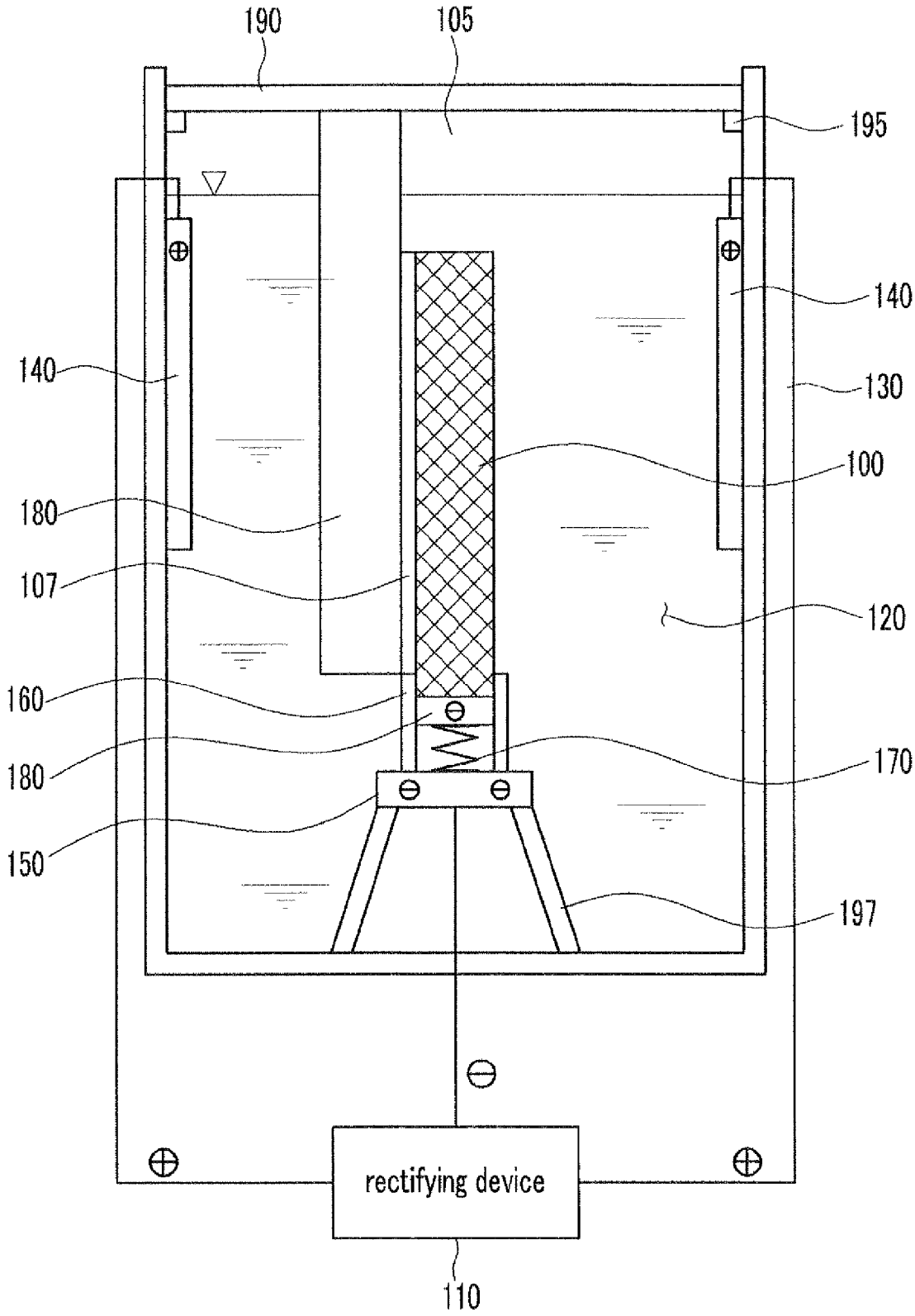
FIG. 1 is an inner schematic diagram of a cleaning device according to an exemplary embodiment of the invention.

The present invention will be described more fully hereinafter with reference to the accompanying drawings, in which exemplary embodiments of the invention are shown. As those skilled in the art will realize, the described embodiments may be modified in various different ways, all without departing from the spirit or scope of the present invention.

Parts that are irrelevant to the description are omitted in order to clearly describe the present invention, and like reference numerals designate like elements throughout the specification.

Furthermore, as the size and thickness of the respective constituent elements shown in the drawings are arbitrarily illustrated for better comprehension and ease of description, the present invention is not necessarily limited to the illustrations.

In the drawings, the thickness of layers, films, panels, regions, etc., are exaggerated for clarity. It will be understood that, when an element such as a layer, film, region or substrate is referred to as being "on" another element, it can be directly on the other element or intervening elements may also be present. In contrast, when an element is referred to as being "directly on" another element, there are no intervening elements present.

FIG. 1 is a schematic diagram of a cleaning device according to an exemplary embodiment of the invention.

Referring to FIG. 1, the cleaning device includes a positive electrode 140, a metal mask 100 as a cleaning target object, a cleaning solution 120, a negative bus bar 150, an elastic member 170, a cleaning solution tank 130 receiving a negative electrode 180, and a rectifying device 110 electrically connected to the positive electrode 140 and the negative electrode 180. A support 197 is installed on the bottom surface of the cleaning solution tank 130, and a catching bar 190 supported by a stopper 195 is installed on the upper portion of the cleaning solution tank 130.

The cleaning solution 120 is filled in the cleaning solution tank 130 to a predetermined height, and a metal jig 105 submerged in the cleaning solution 120 is installed. A metal mask 100 of a stainless or invar material as the cleaning target object is fixed and installed to the metal jig 105. Here, the cleaning target object may be applied as the appropriate cleaning target object to remove the foreign particles, as well as a metal mask capable of being used in the manufacturing process of an electronic device such as the organic light emitting diode (OLED) display.

The negative bus bar 150 supported by the support 197 is fixed and installed at the inner lower portion of the cleaning solution tank 130.

As shown in the drawing, one end of the support 197 is fixed to the bottom surface of the cleaning solution tank 130 and is installed inside the cleaning solution tank 130. However, the one end thereof may be fixed to the side surface of the cleaning solution tank 130.

The negative electrode 180, elastically supported by the elastic member 170, is disposed at an upper portion of the negative bus bar 150, and the guide 160 may be disposed on both sides with respect to the elastic member 170 and the negative electrode 180. This guide 160 may be selectively provided according to design specifications of the cleaning device.

To install the metal jig 105 installed with the metal mask 100 inside the cleaning solution tank 130, if the metal jig 105 is moved in a direction from the upper portion of the cleaning solution tank 130 to the lower portion thereof, the lower cross-sectional surface of the metal mask 100 is adhered to the negative electrode 180. An insulating member 107 for insulating the metal mask 100 and the metal jig 105 is disposed therebetween.

In this case, the elastic member 170 elastically adheres the negative electrode 180 to the metal mask 100.

The catching bar 190 is provided at the upper portion of the metal jig 105, and the catching bar 190 is supported by the stopper 195 formed on the upper portion of the cleaning solution tank 130. Accordingly, the metal jig 105 is strongly supported at a predetermined position in the cleaning solution tank 130.

In addition, the guide 160 guides the movement of the metal jig 105 when the metal jig 105 moves from the upper portion of the cleaning solution tank 130 to the lower portion thereof such that the metal mask 100 and the negative electrode 180 smoothly contact.

As shown in FIG. 1, the plurality of positive electrodes 140 are disposed on both sides of the metal jig 105 so as to be close or adhered to both inner side surfaces of the cleaning solution tank 130. The present exemplary embodiment is a case wherein the plurality of positive electrodes 140 are close to the inner side surface of the cleaning solution tank 130. Here, one positive electrode 140 is disposed so as to correspond to the metal mask 100.

The rectifying device 110 electrically connected to the negative bus bar 150 and the positive electrode 140 is installed outside the cleaning solution tank 130, and the rectifying device 110 applies a negative voltage to the negative bus bar 150 and a positive voltage to the positive electrode 140.

The negative voltage applied to the negative bus bar 150 is transmitted to the metal mask 100 through the elastic member 170 and the negative electrode 180.

Figure 2:
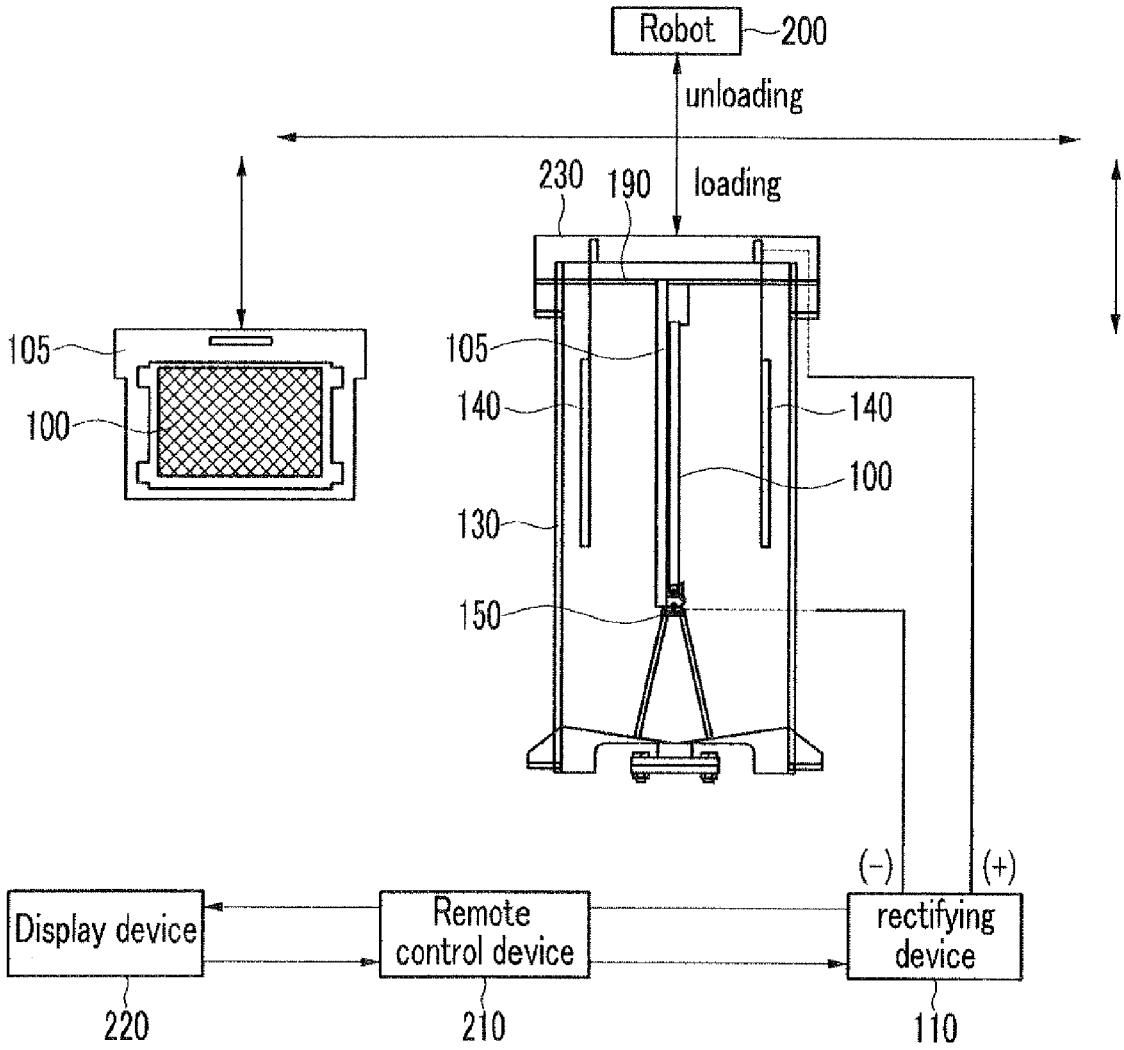
FIG. 2 is an overall system schematic diagram of a cleaning device according to an exemplary embodiment of the invention.

FIG. 2 is an overall system schematic diagram of a cleaning device according to an exemplary embodiment of the invention. Referring to FIG. 2, a robot 200 is disposed on the upper portion of the cleaning solution tank 130, and the robot 200 moves the metal jig 105 in the longitudinal and transverse directions in three-dimensional space so as to load the metal jig 105 at the predetermined position inside the cleaning solution tank 130.

The rectifying device 110 is connected to the remote control device 210, and the remote control device 210 is connected to the display device 220 for displaying the state of the rectifying device 110 and the remote control device 210. In addition, the robot 200 may be controlled by the remote control device 210 according to a predetermined program.

As shown, the cover 230 may be installed at the upper inlet of the cleaning solution tank 130, and the cover 230 may be installed by the robot 200 such that the upper inlet of the cleaning solution tank 130 is closed and sealed.

Figure 3:
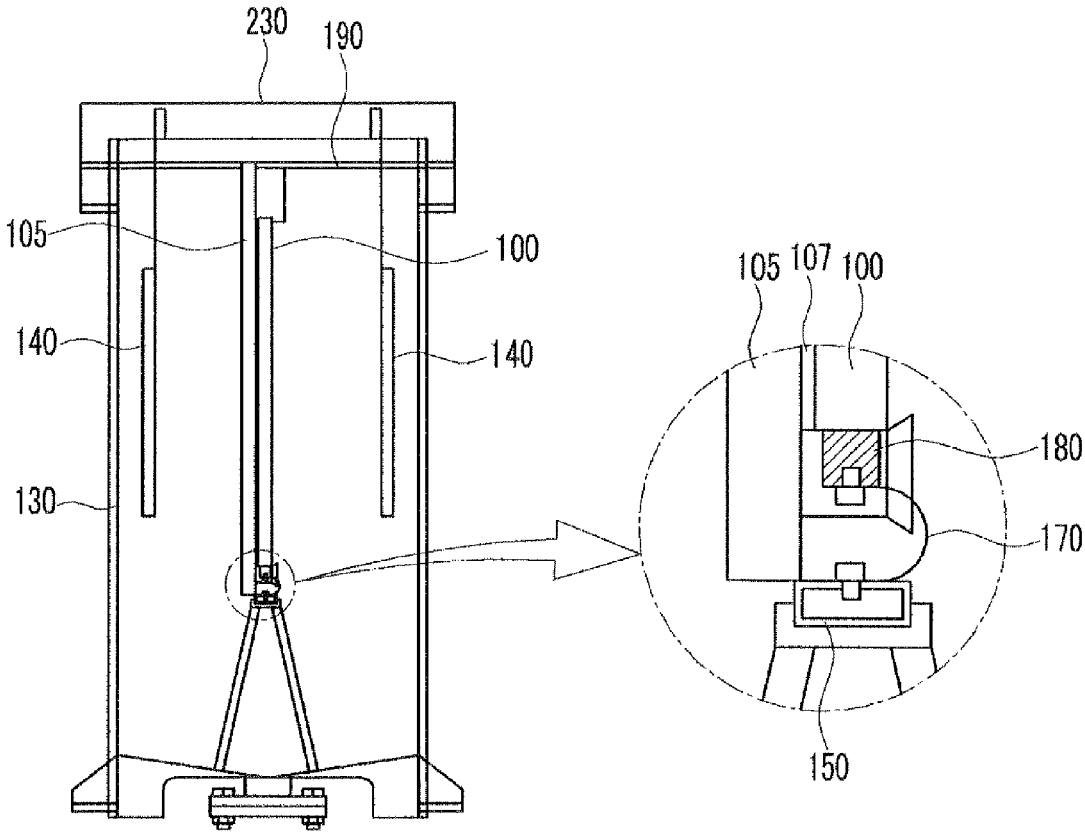
FIG. 3 is an inner side view and a partial detailed view of a cleaning device according to an exemplary embodiment of the invention.

FIG. 3 is an inner side view and a partial detailed view of a cleaning device according to an exemplary embodiment of the invention.

Referring to FIG. 3, the elastic member 170 is installed on the negative bus bar 150, and the negative electrode 180 is provided at an end of the elastic member 170.

The elastic member 170 had a flat spring shape which is curved as a semi-circle, and thereby the negative electrode 180 is elastically adhered to the metal mask 100.

In the exemplary embodiment, when the metal jig 105 enters the cleaning solution tank 130 and one end of the metal jig 105 contacts the negative bus bar 150 so as to be supported, the catching bar 190 contacts the stopper 195 such that the metal jig 105 is disposed in a durable state inside the cleaning solution tank 130.

Figure 4A:
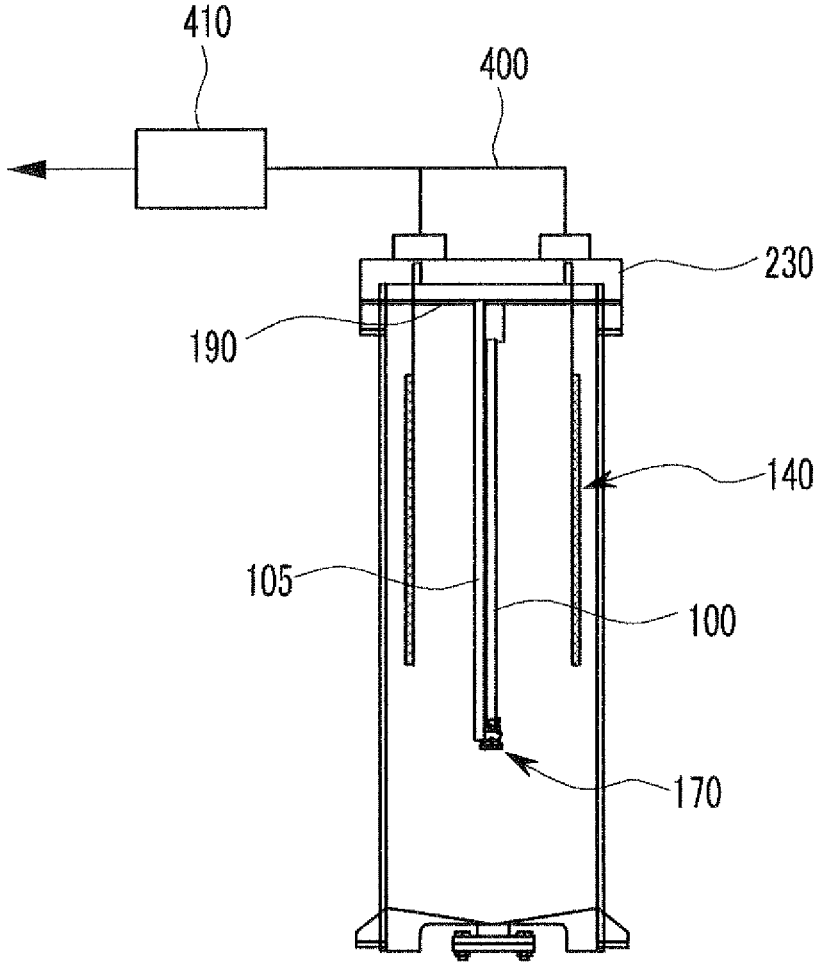
FIG. 4A is an inner front view of a cleaning device according to an exemplary embodiment of the invention.
Figure 4B:
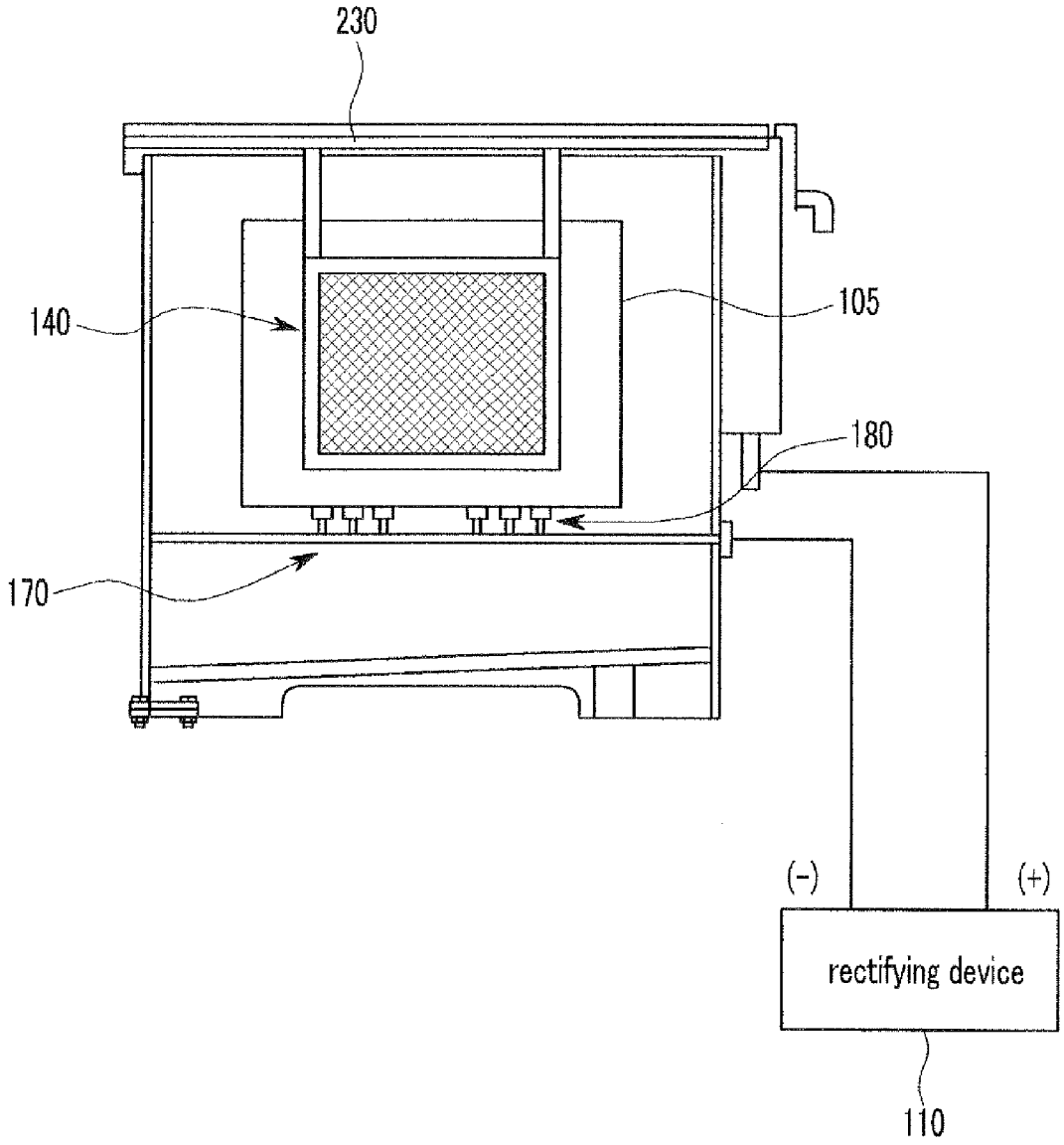
FIG. 4B is a side view of a cleaning device according to an exemplary embodiment of the invention.

FIG. 4A is an inner front view of a cleaning device according to an exemplary embodiment of the invention, and FIG. 4B is a side view of a cleaning device according to an exemplary embodiment of the invention.

Referring to FIGS. 4A and 4B, it is preferable that the cover 230 installed at the upper inlet of the cleaning solution tank 130 has a structure for sealing the upper inlet such that the gas that may be generated inside the cleaning solution tank 130 does not escape.

In addition, the cover 230 is connected to an exhaust line 400 for exhausting a reaction gas generated inside the cleaning solution tank 130, and the exhaust line 400 may be installed with a hydrogen densitometer 410.

Accordingly, hydrogen gas generated in the cleaning solution 120 during the time that the cleaning solution 120 cleans the metal mask 100 is exhausted through the exhaust line 400, the hydrogen densitometer 410 detects the concentration of hydrogen and transmits it to the remote control device 210, and the display device 220 may display the value corresponding thereto.

In the exemplary embodiment, the cleaning device may detect the cleaning state of the metal mask by using the concentration of hydrogen moving through the exhaust line 400.

As described above, by using the robot, the metal jig 105 may be easily loaded at a predetermined position of the cleaning solution tank 130, that is, at the negative bus bar 150 installed at a lower portion of the cleaning solution tank 130.

In addition, the elastic member 170 elastically adheres the metal mask 100 to the negative electrode 180 mounted on the negative bus bar 150 such that the voltage is stably applied, and the cleaning state may be easily confirmed by using the hydrogen densitometer 410 installed on the exhaust line 400.

While this disclosure has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A cleaning device, comprising:

a cleaning solution tank filled with an electrolyte solution to a predetermined height;

a negative electrode provided inside the cleaning solution tank;

a metal jig mounted with a metal mask used to manufacture an organic light emitting diode (OLED) display to one side, and guiding the metal mask to be connected to the negative electrode;

positive electrodes installed at predetermined intervals inside the cleaning solution tank along with the metal mask;

a rectifying device electrically connected to the negative electrode and the positive electrodes;

a negative bus bar installed at a lower portion of the cleaning solution tank for transmitting a negative voltage supplied by the rectifying device to the negative electrode; and an elastic member installed at the negative bus bar for contacting the negative electrode.

2. The cleaning device of claim 1, wherein the upper portion of the metal jig is connected to a catching bar which is slung over one side of the cleaning solution tank.

3. The cleaning device of claim 1, further comprising:

a robot for horizontally and vertically moving the metal jig into a predetermined position so as to load and unload the metal jig inside the cleaning solution tank through an inlet formed in an upper portion of the cleaning solution tank;

a remote control device for remotely controlling the rectifying device and the robot in accordance with a predetermined program; and a display device for displaying a state of the rectifying device and the remote control device.

4. The cleaning device of claim 1, wherein the positive electrodes are installed at an inner surface of the cleaning solution tank at an interval with respect to the metal jig, and the positive electrodes are disposed in correspondence to the metal mask.

5. The cleaning device of claim 1, further comprising a cover covering an upper inlet of the cleaning solution tank, wherein the cover is connected to an exhaust line for exhausting a gas generated in the cleaning solution tank, and the exhaust line is installed with a gas densitometer for detecting the concentration of gas passing through the exhaust line.

6. The cleaning device of claim 5, wherein the gas densitometer is a hydrogen densitometer for detecting the concentration of hydrogen.

7. A cleaning device, comprising:

a cleaning solution tank filled with an electrolyte solution to a predetermined height;

a negative electrode provided inside the cleaning solution tank;

a metal jig mounted with a metal mask used to manufacture an organic light emitting diode (OLED) display to one side, and guiding the metal mask to be connected to the negative electrode;

positive electrodes installed at predetermined intervals inside the cleaning solution tank along with the metal mask;

a rectifying device electrically connected to the negative electrode and the positive electrodes; and an insulating member interposed between the metal mask and the metal jig.

* * * * *